US006880321B2

(12) United States Patent
Guevel et al.

(10) Patent No.: US 6,880,321 B2
(45) Date of Patent: Apr. 19, 2005

(54) CUT-RESISTANT YARN INTENDED ESPECIALLY FOR THE PRODUCTION OF PROTECTIVE GARMENTS

(75) Inventors: Jean Guevel, Lyons (FR); Guy Bontemps, Tenay (FR)

(73) Assignee: SA Schappe, Ban de Laveline (FR)

( * ) Notice: Subject to any disclaimer, the term of this patent is extended or adjusted under 35 U.S.C. 154(b) by 63 days.

(21) Appl. No.: 10/337,350

(22) Filed: Jan. 7, 2003

(65) Prior Publication Data

US 2003/0159422 A1 Aug. 28, 2003

(30) Foreign Application Priority Data

Jan. 10, 2002 (FR) ..... 02 00264

(51) Int. Cl.[7] ..... D02G 3/04; D02G 3/18
(52) U.S. Cl. ..... 57/229
(58) Field of Search ..... 65/432, 447, 450; 57/210, 229

(56) References Cited

U.S. PATENT DOCUMENTS

| | | | | | |
|---|---|---|---|---|---|
| 3,840,426 | A | * | 10/1974 | Flautt et al. | 442/331 |
| 3,883,898 | A | | 5/1975 | Byrnes, Sr. | |
| 4,004,295 | A | | 1/1977 | Byrnes, Sr. | |
| 4,265,972 | A | * | 5/1981 | Rudner | 428/392 |
| 4,274,448 | A | * | 6/1981 | Westhead | 139/383 A |
| 4,530,206 | A | * | 7/1985 | Benichou et al. | 57/250 |
| 4,774,135 | A | * | 9/1988 | Bryant | 428/392 |
| 4,777,789 | A | | 10/1988 | Kolmes et al. | |
| 4,989,947 | A | * | 2/1991 | Sasaki et al. | 385/143 |
| 5,136,679 | A | * | 8/1992 | Broer et al. | 385/128 |
| 6,216,431 | B1 | * | 4/2001 | Andrews | 57/210 |
| 6,279,305 | B1 | * | 8/2001 | Hummel | 57/210 |

FOREIGN PATENT DOCUMENTS

| | | |
|---|---|---|
| DE | 1 610 495 | 1/1971 |
| EP | 0 118 898 A2 | 9/1984 |
| GB | 2 018 323 A | 10/1979 |
| GB | 1 586 890 | 3/1981 |

* cited by examiner

*Primary Examiner*—John J. Calvert
*Assistant Examiner*—Shaun R Hurley
(74) *Attorney, Agent, or Firm*—Oliff & Berridge, PLC

(57) ABSTRACT

Yarn comprising a core (A) obtained by coextrusion of a multifilament of E-, R-, C- or S-glass or more generally of textile glass or basalt filament and of a sheath of polymer of thermoplastic, thermosetting, natural elastomer or synthetic elastomer type, fluorinated or otherwise. The glass fiber part represents at most 60% by weight of the filament and sheath compound, and the core (A) is assembled or twisted with staple fiber yarns composed of synthetic fibers (B).

14 Claims, 1 Drawing Sheet

CUT-RESISTANT YARN INTENDED ESPECIALLY FOR THE PRODUCTION OF PROTECTIVE GARMENTS

BACKGROUND OF THE INVENTION

1. Field of the Invention

The subject of the present invention is a cut-resistant yarn intended especially for the production of garments for protection against mechanical attack.

2. Description of the Related Art

It is widely known in the literature, and from the patents U.S. Pat. No. 3,883,898, GB 1 586 890, U.S. Pat. Nos. 4,777,789, 4,004,295, GB 2 018 323, DE 1 610 495 and, EP 0 118 898, that the combination of various fibrous materials of polymeric origin, or inorganic origin in the family of vitreous or ceramic, or metallic, compounds, are employed for the purposes of reinforcing yarns intended for the field of protection against mechanical attack and/or perforation.

Such personal protection equipment is most often in the form of gloves, sleeves, aprons or any part of a garment, and are generally knitted or, more rarely woven.

These parts of protective equipment must possess very good mechanical properties, in particular as regards shear stresses, without loosing the flexibility and the lightness that are necessary for good dexterity.

In general, particular polymers are found to be the materials employed, such as polyamides, para-aramids, highmolecular-weight polyethylenes, LCP (Liquid-Crystal Polymer) fibres, polybenzimidazole and ceramic-filled polyester. These materials have in common the particular feature of being highly crystalline and consequently possessing a fairly high intrinsic hardness. This is because the hardness of the materials used is very high and substantially governs the cutting or shearing mechanisms to which they are exposed. As an indication, crystalline and semicrystalline polymeric materials have hardnesses, measured on the Mohs scale, of between 2 and 3.

The yarns made of pure polymers chosen from the above materials, do not make it possible to achieve Class 5 classifications according to the European Standard EN388 for thin knits, ensuring good dexterity as must be the case with protective gloves intended for cutting. Such personal protection equipment, greatly used in the field of sheet metalwork, must, in addition to providing users with good grip, be very comfortable, ensuring that the equipment will always be worn by exposed personnel.

To solve the compromise, allowing gloves to be produced that are both flexible and light, and therefore comfortable, while still being classified as Class 5 according to EN388, many companies incorporate inorganic filaments in combination with polymeric filaments. Glass and stainless steel are generally used for reinforcement, without making the yarns intended for producing the cut-resistant protective gloves too heavy. The Mohs hardness of steel is 5 and that of glass is 6/7.

The Products Proposed Have Two Major Drawbacks:

The glass or stainless steel filaments have a low bending resistance and break. The free ends, despite assemblies of polymer filaments intended to sheath them using wrapping operations, end up with them passing through the layers of the wrapped polymer filaments, the effect of which is to prick the hands of operators, who generally no longer wear the protective equipment.

To solve this problem, a glass treatment process, existing in the sunshade industry, has been profitably used. In this field, the glass filaments are used for their non-inflammable properties (M0 classification). These sunshades are placed inside buildings in front of windows and must fulfil, in addition to solar filtration, an aesthetic function. For these purposes, the glass filament, generally called textile glass filament, is coextruded with a polymeric resin fire-retarded in the bulk and tinted to the desired colour. These yarns are then woven and thermally fused at the intersection of the yarns to lock the network of yarns.

SUMMARY OF THE INVENTION

The object of the invention is to provide a cut-resistant yarn allowing the production of protective equipment which provides users with good safety and possesses good flexibility, conducive to comfort.

For this purpose, the yarn to which the invention relates, comprising a core obtained by coextrusion of a multifilament of E-, R-, C- or S-glass or more generally of textile glass or basalt filament and of a sheath of polymer of the thermoplastic, thermosetting, natural elastomer or synthetic elastomer type, fluorinated or otherwise, is characterized in that the glass fibre part represents at most 60% by weight of the filament+sheath compound, and in that the core is assembled or twisted with staple fibre yarns composed of synthetic fibres.

The core and the staple fibre yarns composed of synthetic fibres are either assembled or twisted together in the "S" or "Z" sense.

The coextrusion part makes the core yarn more flexible than if it were made entirely of glass. Furthermore, the staple fibre yarns are absolutely locked by the contact of the polymer constituting them on the coextruded polymer.

Thus, knitted products are obtained which achieve very high levels of abrasion resistance. Another substantial advantage is the protection of the glass filament against attack by chemicals, in particular hydrofloric acid, in certain chemical or related industry sectors.

The extruded polymer sheath creates a perfect seal for the axial component consisting of the glass filament. The polymers used may be polyvinyl chlorides or polyurethanes, or any other chemically inert polymer.

As regards cut performance, level 5 is achieved very easily and is maintained even after 10 washings.

According to one feature of this yarn, the staple fibre yarns are chosen from the following families: polyethylene having a high molecular weight, greater than 600,000 g/mol, para-aramid having a modulus>50 GPa, high-tenacity and standard-tenacity polyamide, high-tenacity and standard-tenacity polyester, liquid-crystal polymer (LCP), polyphenylenebenzobisoxazole (PBO) and ceramic-filled polyester.

According to one embodiment, the staple fibre yarns consist of identical materials.

According to another embodiment, the staple fibre yarns consist, at least in the case of some of them, of different materials.

According to one possibility, the staple fibre yarns comprise fibres belonging to the plant or animal kingdom.

Four illustrative embodiments of a yarn according to the invention are described below with reference to the four figures of the appended schematic drawing, respectively.

Figure 1:
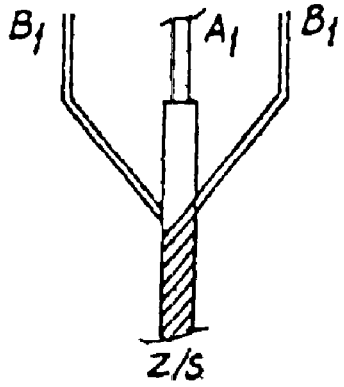
FIG. 1 shows a yarn of one embodiment of the present invention which is composed of two identical staple fiber yarns of high molecular weight polyethylene fibers.

1st Hybrid Yarn (FIG. 1)

The yarn is composed of two 28/1 Nm (357 dtex) identical staple fibre yarns ($B_1$) of long or short fibres, each composed of high-molecular-weight polyethylene fibres, blended with nylon-6,6, nylon-6 or nylon-4,6 in the proportion of 37% polyethylene to 63% polyamide fibres. A glass yarn coextruded with a polymer sheath $A_1$ 950 of dtex linear density constitutes the third component. This assembly is then twisted with an "S" or "Z" twist with a ratio between 0 and 200 turns/m. Linear density of the hybrid yarn: 2×357+950=1664 dtex (6 Nm).

Figure 2:
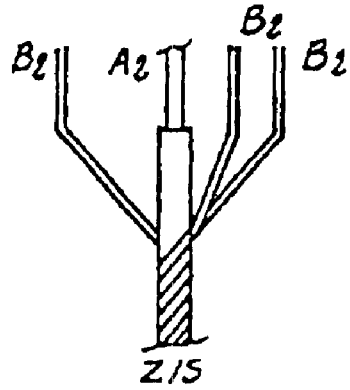
FIG. 2 shows a yarn of one embodiment of the present invention which is composed of three identical fibers composed of a high molecular weight polyethylene fiber.

$2^{nd}$ Hybrid Yarn (FIG. 2)

The yarn is composed of three 50/1 Nm (200 dtex) identical staple fibre yarns ($B_2$) of long or short fibres, each composed of high-molecular-weight polyethylene fibres, blended with nylon-6,6, nylon-6 or nylon-4,6 fibres, in the proportion of 37% polyethylene to 63% polyamide fibres. A glass yarn coextruded with a polymer sheath ($A_2$) constitutes the fourth component.

This assembly is then twisted with an "S" or "Z" twist with a ratio of between 0 and 200 turns/m. Linear density of the hybrid yarn: 3×200+950=1550 dtex (6.5 Nm).

Figure 3:
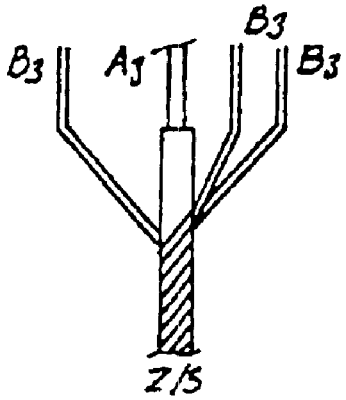
FIG. 3 shows a yarn of one embodiment of the present invention which is composed of three identical fibers composed of para-aramid fibers.

$3^{rd}$ Hybrid Yarn (FIG. 3)

The yarn is composed of three 50/1 Nm (200 dtex) identical staple fibre yarns ($B_3$) of long or short fibres, each composed of para-aramid fibres. A glass yarn coextruded with a polymer sheath ($A_3$) of 950 dtex linear density constitutes the fourth component. This assembly is then twisted with an "S" or "Z" twist with a ratio of between 0 and 200 turns/m. Linear density of the hybrid yarn: 3×200+950=1550 dtex (6.5 Nm).

Figure 4:
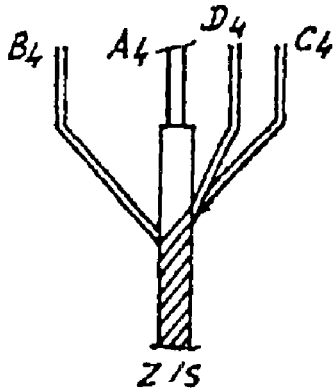
FIG. 4 shows a yarn of one embodiment of the present invention which is composed of three non-identical fibers.

4th Hybrid Yarn (FIG. 4)

The yarn is composed of three 50/1 Nm (200 dtex) non-identical staple fibre yarns ($B_4$, $C_4$, $D_4$) of long or short fibres, composed of two staple fibre yarns of long or short fibres, based on high-molecular-weight polyethylene fibres, blended with nylon-6,6, nylon-6 or nylon-4,6 fibres, in the proportion of 37% polyethylene to 63% polyamide fibres. A third, 50/1 Nm (200 dtex) yarn, as a staple fibre yarn of long or short fibres is added to the two previous ones. The material chosen for this yarn is a nylon-6, nylon-6,6 or nylon-4,6. A glass yarn coextruded with polymer sheath ($A_4$) of 950 dtex linear density constitutes the fourth element of this assembly.

The performance levels achieved are very high and similar to metal protection solutions that are much more restrictive for operators, particularly because of the weight of the equipment.

What is claimed is:

1. Cut-resistant yarn, comprising a core obtained by coextrusion of a glass fiber part comprised of a multifilament of E-, R-, C- or S-glass, or of textile glass or basalt filament, and of a sheath of polymer of thermoplastic, thermosetting, natural elastomer or synthetic elastomer, optionally fluorinated, wherein the glass fiber part represents at most 60% by weight of the core, and wherein the core is assembled or twisted with staple fiber yarns comprising synthetic fibers, plant or animal fibers, or mixtures thereof.

2. Yarn according to claim 1, wherein the core and the staple fiber yarns are either assembled or twisted together in an "S" or "Z" sense.

3. Yarn according to claim 1, wherein the staple fiber yarns are composed of synthetic fibers and are chosen from the group consisting of polyethylene having a high molecular weight greater than 600,000 g/mol, para-aramid having a modulus >50 GPa, high-tenacity and standard-tenacity polyamide, high-tenacity and standard-tenacity polyester, liquid-crystal polymer (LCP), polyphenylenebenzobisoxazole (PBO) and ceramic-filled polyester.

4. Yarn according to claim 1, wherein the staple fiber yarns comprise plant or animal fibers.

5. Yarn according to claim 1, wherein the staple fiber yarns are composed of synthetic fibers and consist of identical materials.

6. Yarn according to claim 1, wherein a multiplicity of staple fiber yarns composed of synthetic fibers are used and wherein the synthetic fibers comprise, at least for some of them, different materials.

7. Yarn according to claim 2, wherein the staple fiber yarns are composed of synthetic fibers and are chosen from the group consisting of polyethylene having a high molecular weight, greater than 600,000 g/mol, para-aramid having a modulus >50 GPa, high-tenacity and standard-tenacity polyamide, high-tenacity and standard-tenacity polyester, liquid-crystal polymer (LCP), polyphenylenebenzobisoxazole (PBO) and ceramic-filled polyester.

8. Yarn according to claim 2, wherein the staple fiber yarns comprise plant or animal fibers.

9. Yarn according to claim 3, wherein the staple fiber yarns further comprise plant or animal fibers.

10. Yarn according to claim 2, wherein the staple fiber yarns are composed of synthetic fibers and consist of identical materials.

11. Yarn according to claim 3, wherein the staple fiber yarns are composed of synthetic fibers and consist of identical materials.

12. Yarn according to claim 4, wherein the staple fiber yarns are further composed of synthetic fibers that consist of identical materials.

13. Yarn according to claim 2, wherein a multiplicity of staple fiber yarns composed of synthetic fibers are used and wherein the synthetic fibers comprise, at least for some of them, different materials.

14. Yarn according to claim 3, wherein a multiplicity of staple fiber yarns composed of synthetic fibers are used and wherein the various synthetic fibers comprise, at least for some of them, different materials.

* * * * *